US006161488A

United States Patent [19]

Reddicliffe

[11] Patent Number: 6,161,488

[45] Date of Patent: Dec. 19, 2000

[54] SHELF

[76] Inventor: Edward A Reddicliffe, Lymington, Hants SO41 8PS, United Kingdom

[21] Appl. No.: 09/238,836

[22] Filed: Jan. 27, 1999

[30] Foreign Application Priority Data

Jan. 28, 1998 [EP] European Pat. Off. ..... 98300598

[51] Int. Cl.[7] ..... A47B 1/04; A47B 5/08

[52] U.S. Cl. ..... 108/69; 108/147.11; 108/65; 211/135; 211/153; 211/187

[58] Field of Search ..... 108/180, 11, 12, 108/65, 69, 147.11, 165; 211/135, 153, 187, 150

[56] References Cited

U.S. PATENT DOCUMENTS

| | | | |
|---|---|---|---|
| 543,959 | 8/1895 | Foster | 211/153 |
| 1,876,494 | 9/1932 | Furo | 211/153 |
| 2,251,799 | 8/1941 | Nave | 312/408 |
| 2,298,352 | 10/1942 | Downes | 211/153 X |
| 2,975,908 | 3/1961 | Huet . | |
| 3,625,371 | 12/1971 | Dill | 211/153 |
| 3,986,616 | 10/1976 | Gray | 108/107 X |
| 4,106,413 | 8/1978 | Hoaglund | 108/12 |
| 5,221,013 | 6/1993 | Santucci | 211/153 |
| 5,406,895 | 4/1995 | Suess | 211/153 X |
| 5,415,472 | 5/1995 | Brise . | |
| 5,715,957 | 2/1998 | Merl | 211/187 |

FOREIGN PATENT DOCUMENTS

| | | |
|---|---|---|
| 1318343 | 5/1993 | Canada . |
| 0401052 | 12/1990 | European Pat. Off. . |
| 2245156 | 1/1992 | United Kingdom . |

*Primary Examiner*—Peter M. Cuomo
*Assistant Examiner*—Hanh V. Tran
*Attorney, Agent, or Firm*—Baker & Daniels

[57] ABSTRACT

A shelf (1) for a cabinet. The shelf has a hinged flap (7,8) at either end. When the shelf is lifted, the flaps pivot downwardly under gravity to cause an effective reduction in the width of the shelf allowing the shelf to be removed between two front posts of the cabinet.

13 Claims, 1 Drawing Sheet

1
2
3
6
7
8
9
10
11
12
13
14

1
3
4
8
10

SHELF

The present invention relates to a shelf for a cabinet, for example used for housing electronic equipment.

In such cabinets, the shelves are usually fastened with nuts, bolts, loose fittings or brackets of some sort. These can fall into sensitive electronic equipment and cause damage. In addition, when the cabinet is of the type which is supported by a post in or near each corner, a shelf which provides a full mounting width across the cabinet cannot normally be removed unless the shelf is tipped to reduce its effective width allowing it to fit between the posts. Tipping is sometimes impossible when the cabinet is densely packed as there is an insufficient gap between the pieces of equipment to tip between the shelf sufficiently. The width of a shelf may therefore have to be reduced to the distance between the mounting posts, thereby reducing the available shelf space within the cabinet and would not actually be possible when the mounting surfaces of the mounting posts are a greater distance apart than the distance between the innermost edges of the mounting posts.

According to the present invention, a shelf for a cabinet is supportable at both ends in the cabinet and comprises a main body having a hinged flap at least one end, the hinged flap being hinged about an axis perpendicular to the width of the shelf, allowing the hinged flap to be moved out of the plane of the main body to cause an effective reduction in the width of the shelf. By "width" of the shelf is meant the dimension from one end of the shelf to the other, and not the dimension from the front of the shelf to the back.

Instead of tilting the shelf, the or each flap is simply moved out of the plane of the main body, thereby reducing the effective width of the shelf to a size which will fit between the front posts of the cabinet. Although some tilting may be necessary this will be for less that for a shelf with no flaps. As the flap is at the end of the main body of the shelf, the bending moments acting on the hinge when the shelf is loaded are less than they would be for a shelf hinged towards the center.

Preferably the main body occupies more than 80%, and more preferably more than 90%, and most preferably substantially 92% of the width of the upper surface of the shelf.

Also, if the main body is a unitary member, because the flap is at the end of the shelf, the main body can accommodate a telescopic shelf which is slidable in the direction of the axis of the hinged flap.

The or each flap is preferably permanently attached. Such a shelf has no removable parts, so that there is no danger of any loose fittings falling into the equipment.

If a hinged flap is provided at each end of the shelf, the vertical distance taken up by each flap when the flaps are moved out of the plane of the main body is less than the vertical distance taken by only one flap allowing closer spacing of the shelves.

The or each flap may be movable upwardly or downwardly to reduce the width of the shelf. However, if the or each flap is arranged so that, when the shelf is raised, the flap moves downwardly under gravity, this allows the shelf to be removed simply by raising it, whereupon the or each flap moves downwardly, and sliding it forwards out of the cabinet.

Both ends of the shelf preferably have some means for engaging a support on the cabinet, such as projecting lugs on the or each flap, each of which lugs engages with one of a line of holes in each post. This means is preferably a punched lug, as this provides high strength.

The facing surfaces of the main body and the or each flap preferably abut one another when the shelf is fitted in the cabinet so that the shelf is kept rigid without requiring a catch mechanism between the main body and the or each flap. The interface between the main body and the or each hinged flap is preferably inclined, so that, when the shelf is viewed from the front, the incline is downwards and inwards. This increases the load capacity reduces the deflection of the shelf and provides easy clearance for the radial swing of the flap.

The axis along which the or each flap is hinged to the main body of the shelf is preferably off-set inwardly from the edge of the main body, and the or each flap is preferably provided at each end with a flange, which extends to, and is pivotally supported at the hinge axis. This construction provides a small radius of swing so that the distance between adjacent shelves in a cabinet can be minimised. If the flange is laminar and is provided in a plane perpendicular to the axis of the hinge, it will be very strong in shear when the shelf is loaded.

One example of a shelf constructed in accordance with the present invention will now be described with reference to the accompanying drawing, in which.

Figures 1, 2:
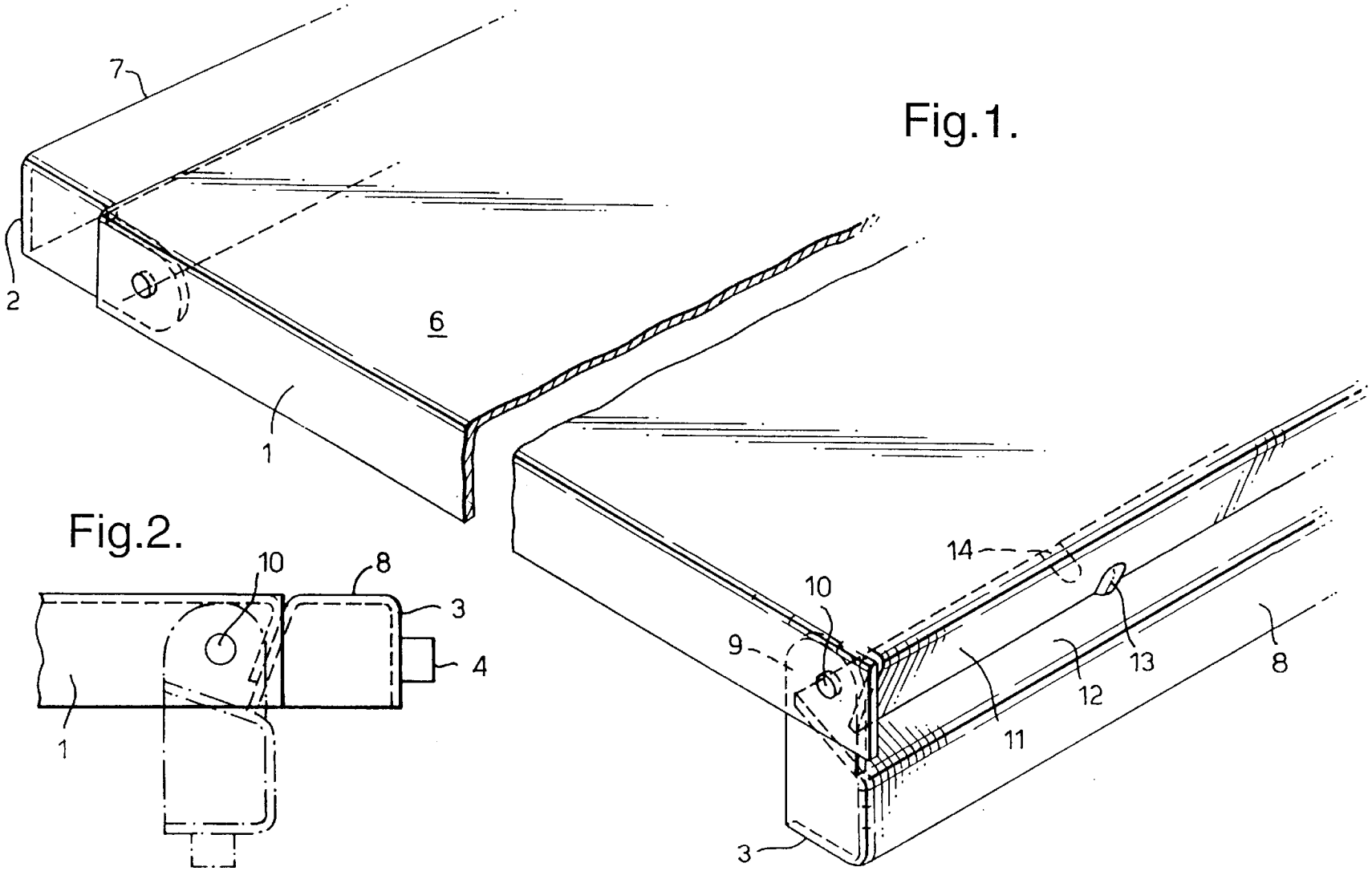
FIG. 1 is a diagrammatic perspective view of part of a shelf.
FIG. 2 is a view showing the detail of one end.

The shelf has a front 1, and two lateral ends 2, 3, at which the shelf is supported in a cabinet by virtue of engagement between punched lugs 4 (as shown in FIG. 2) which engage with corresponding holes in the posts of the cabinet.

The shelf comprises a main body 6, at either end of which is provided a hinged flap 7, 8. A flange 9 projects at each end of each hinged flap 7, 8, and is permanently on pivotally connected to the main body 6 by hinged joint 10. The flanges 9 are within the main body 6, so that the upper edge of each flange provides an accurate dead stop against the underside of the main body 6, and so as to provide an alternative reference surface to ensure that the main body and flaps rest in a perfectly horizontal position. The facing surfaces 11, 12 of the main body 6 and hinged flaps 7, 8 are inclined downwardly and inward.

With both hinged flaps 7, 8 hinged downwardly as shown on the right hand side of the figure, the shelf is slid between the front posts of the cabinet into the cabinet above the support on which it is to rest. The user then moves the two hinged flaps 7, 8 into their upward position as shown on the left hand side of the figure, and lowers the shelf until the lugs 4 engage the holes in the posts at the desired height.

In order to remove the shelf, the main body 6 is lifted, and the hinged flaps 7, 8 move to their downward position under gravity. The shelf can then be slid out of the cabinet between the front posts.

Dimples 13 are provided on the surface 11 of the main body. These provide interference points against areas 14 on the flap when the shelf is in place in the cabinet and give a slight locking effect to prevent the shelves from being too easily knocked out.

What is claimed is:

1. A shelf for a cabinet, the shelf being supportable at both ends in the cabinet and comprising a main body having a hinged flap at least one end, the hinged flap being hinged about an axis perpendicular to a width of the shelf, allowing the hinged flap to be moved out of the plane of the main body to cause an effective reduction in the width of the shelf, facing surfaces of the main body and the flap abut one another at an interface when the shelf is fitted in the cabinet so that the shelf is kept rigid without requiring a catch mechanism between the main body and the flap, wherein the interface between the main body and the hinged flap is inclined, so that, when the shelf is viewed from the front, the incline is downwards and inwards relative to the center of the main body.

2. A shelf according to claim 1, wherein the main body occupies more than 80% of the width of the upper surface of the shelf.

3. A shelf according to claim 2, wherein the main body is a unitary member.

4. The shelf according to claim 2 wherein the main body occupies more than 90% of the width of the upper surface of the shelf.

5. It The shelf according to claim 2 wherein the main body occupies more than 92% of the width of the upper surface of the shelf.

6. A shelf according to claim 1, wherein the main body is a unitary member.

7. A shelf according to claim 1, wherein the flap is permanently attached to the main body.

8. A shelf according to claim 1, wherein a said hinged flap is provided at each end of the shelf.

9. A shelf according to claim 1, wherein the flap is arranged so that, when the shelf is raised, the flap moves downwardly under gravity.

10. A shelf according to claim 1, wherein both ends of the shelf have some means for engaging a support on the cabinet.

11. A shelf according to claim 10, wherein the means for engaging a support are punched lugs.

12. A shelf according to claim 1, wherein the axis along which the flap is hinged to the main body of the shelf is off-set inwardly from the interface of the main body and the hinged flap, and the flap is provided at each end with a flange, which extends to, and is pivotally supported at the hinge axis.

13. A shelf according to claim 1, wherein the main body is provided with dimples on a surface facing the corresponding flap so that the dimples provide interference points when the shelf is installed in a cabinet.

* * * * *